US009334681B2

(12) United States Patent
Fernandez-Aguilera et al.

(10) Patent No.: US 9,334,681 B2
(45) Date of Patent: May 10, 2016

(54) AUTOMATIC DOOR CHILD SAFETY LOCK RELEASE IN A CRASH EVENT

(71) Applicant: Continental Automotive Systems, Inc., Auburn Hills, MI (US)

(72) Inventors: David Fernandez-Aguilera, Guadalajara (MX); Arturo Carlos-Gonzalez, Zapopan (MX)

(73) Assignee: Continental Automotive Systems, Inc., Auburn Hills, MI (US)

( * ) Notice: Subject to any disclaimer, the term of this patent is extended or adjusted under 35 U.S.C. 154(b) by 0 days.

(21) Appl. No.: 14/620,879

(22) Filed: Feb. 12, 2015

(65) Prior Publication Data

US 2016/0097224 A1 Apr. 7, 2016

Related U.S. Application Data

(60) Provisional application No. 62/059,519, filed on Oct. 3, 2014.

(51) Int. Cl.

| | |
|---|---|
| ***E05B 77/26*** | (2014.01) |
| ***E05B 77/02*** | (2014.01) |
| ***E05B 77/54*** | (2014.01) |
| ***E05B 81/58*** | (2014.01) |

(52) U.S. Cl.

CPC ..... *E05B 77/26* (2013.01); *E05B 77/02* (2013.01); *E05B 77/54* (2013.01); *E05B 81/58* (2013.01)

(58) Field of Classification Search

None

See application file for complete search history.

(56) References Cited

U.S. PATENT DOCUMENTS

| | | | | |
|---|---|---|---|---|
| 4,652,768 | A | 3/1987 | Gmeiner et al. | |
| 5,228,757 | A * | 7/1993 | Ito | B60T 8/1755 303/146 |
| 6,155,655 | A * | 12/2000 | Matsuno | B60T 8/1755 303/140 |
| 6,157,090 | A | 12/2000 | Vogel et al. | |
| 6,778,890 | B2 * | 8/2004 | Shimakage | B62D 15/025 180/443 |
| 7,352,081 | B2 | 4/2008 | Taurasi | |
| 7,380,632 | B2 | 6/2008 | Claar et al. | |
| 7,526,372 | B2 * | 4/2009 | Tsutsumi | B62D 5/003 180/405 |
| 7,558,662 | B2 * | 7/2009 | Yamaguchi | B60T 8/17552 180/412 |
| 7,698,032 | B2 * | 4/2010 | Matsumoto | B60T 8/17557 180/170 |
| 8,303,003 | B2 | 11/2012 | Berghahn et al. | |
| 8,740,264 | B2 | 6/2014 | Akizuki et al. | |
| 2003/0078712 | A1 * | 4/2003 | Shimakage | B62D 1/286 701/41 |
| 2004/0113486 | A1 * | 6/2004 | Koga | B60T 7/107 303/20 |
| 2004/0124027 | A1 | 7/2004 | Aiyama et al. | |
| 2005/0113999 | A1 * | 5/2005 | Tange | B60T 8/17557 701/41 |
| 2005/0125153 | A1 * | 6/2005 | Matsumoto | B60T 8/17557 701/300 |
| 2005/0146215 | A1 | 7/2005 | Kachouch et al. | |
| 2006/0190151 | A1 * | 8/2006 | Tsutsumi | B62D 5/003 701/41 |
| 2007/0032937 | A1 * | 2/2007 | Yamaguchi | B60T 8/17552 701/70 |
| 2015/0183428 | A1 * | 7/2015 | Nishigaki | B60T 8/1755 701/41 |

* cited by examiner

*Primary Examiner* — Fadey Jabr
*Assistant Examiner* — Krishnan Ramesh

(57) ABSTRACT

An automated child safety unlocking system for automobiles which disengages the child safety locks and unlocks the doors at appropriate times during events such as vehicle crashes. The vehicle ECU continually monitors the status of the vehicle to check if a crash event has occurred via various methods such as the status of airbag deployment, accelerometers placed in the car, and crumple points. In the event of a crash the vehicle ECU transmits one of at least two CSL command signals a child safety lock ECU. The command signals are each specific to an event severity and event type, and the child safety lock ECU then interprets the signal and acts according to the signal type. If the data interpreted indicates a crash, the child safety lock ECU unlocks the child safety locks, and if it does not determine a crash has not occurred, the locks remain engaged.

21 Claims, 6 Drawing Sheets

AUTOMATIC DOOR CHILD SAFETY LOCK RELEASE IN A CRASH EVENT

CROSS-REFERENCE TO RELATED APPLICATIONS

This application claims the benefit of U.S. Provisional Application No. 62/059,519 filed Oct. 3, 2014.

FIELD OF THE INVENTION

The present invention is related to an automatic child safety lock release during an accident.

BACKGROUND OF THE INVENTION

"Child safety locks" are present on most vehicles. In particular, vehicles with a back seat have a manual release in the outer portion of the door which is exposed by opening of the door. Typically, there is a recessed switch in the door that is actuated by a screwdriver, or key, or by hand, and switched manually from an open position where the locks function in a normal manner, or a locked position where the exposed locks in a rear door cannot be manually manipulated by a rear seat occupant.

The purpose for this type of lock is to avoid undesired opening by a child or other rear seat occupant of the rear door which might place the child or occupant at risk. Additionally, the door cannot be opened from the outside which also protects the child from external unwanted entries by strangers or the like.

While this acts to protect the child or other occupant during normal operation of the vehicle, the child locks can produce a potentially dangerous situation. For example, if there is an accident and the vehicle catches on fire, the child or any occupant from the rear seat cannot be removed from the vehicle by opening the door from the inside or outside unless the door is unlocked from a different location like a key fob or door unlock switch near front seats. In the case of a rollover accident or other accident, the passenger cannot exit nor potentially can a rescue person open the rear door for removal of the occupant.

Therefore, there is a need in the art to provide an automated child safety device that opens upon impact.

SUMMARY OF THE INVENTION

The present invention relates to an automated child safety unlocking system for automobiles which disengages the child safety locks and unlocks the doors at appropriate times during events such as vehicle crashes. The system includes two or more crash sensors each configured to generate a crash signal upon detection of an event, such as the vehicle striking an object. A vehicle ECU is configured to receive the crash signal from each of the two or more crash sensors and then transmit one of at least two CSL command signals. The vehicle ECU continually monitors the status of the vehicle to check if a crash event has occurred via various methods such as the status of airbag deployment, accelerometers placed in the car, and crumple points. The at least two CSL command signals are each specific to an event severity and event type, where one of at least two CSL command signals generated by the vehicle ECU is transmitted with general signals over a general vehicle communication bus. The signal generated by the vehicle ECU is continually passed to a child safety lock ECU which then interprets the signal and acts according to the signal. If the data interpreted indicates a severe crash, the child safety lock ECU unlocks the child safety locks immediately, and if it is determined a minor crash or no crash has occurred, the locks remain engaged.

The child safety lock ECU is configured to receive the general signals transmitted through the general vehicle communication bus and filter the one of at least two CSL command signals from the general vehicle communication bus signal. The child safety lock ECU engages or disengages a child safety lock actuator depending on the one of at least two CSL command signals received by the child safety lock ECU.

The system becomes engaged (i.e. the ECUs are activated and begin transmission) upon start-up of the vehicle and are subsequently re-initialized upon successive start-ups.

Various other data is transmitted along with the signals from the vehicle ECU provide different functionality. A rolling counter is employed in order to ensure consistent transmission of data from the ECUs. General data on the operation of the ECUs is transmitted concerning the operating parameters of the ECU such as, but not limited to, voltages, temperatures, and number of transmissions by the ECUs. This data can be interpreted in order to provide optimal operation by the ECU. Checksum protection is transmitted in order to verify the entire signal has been sent from the vehicle ECU to the child safety lock ECU and prevent miscommunication between the ECUs. An ECU identification signal is employed in order to establish the identity of the ECU which is currently transmitting.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION OF THE PREFERRED EMBODIMENTS

The following description of the preferred embodiment(s) is merely exemplary in nature and is in no way intended to limit the invention, its application, or uses.

Figure 1:
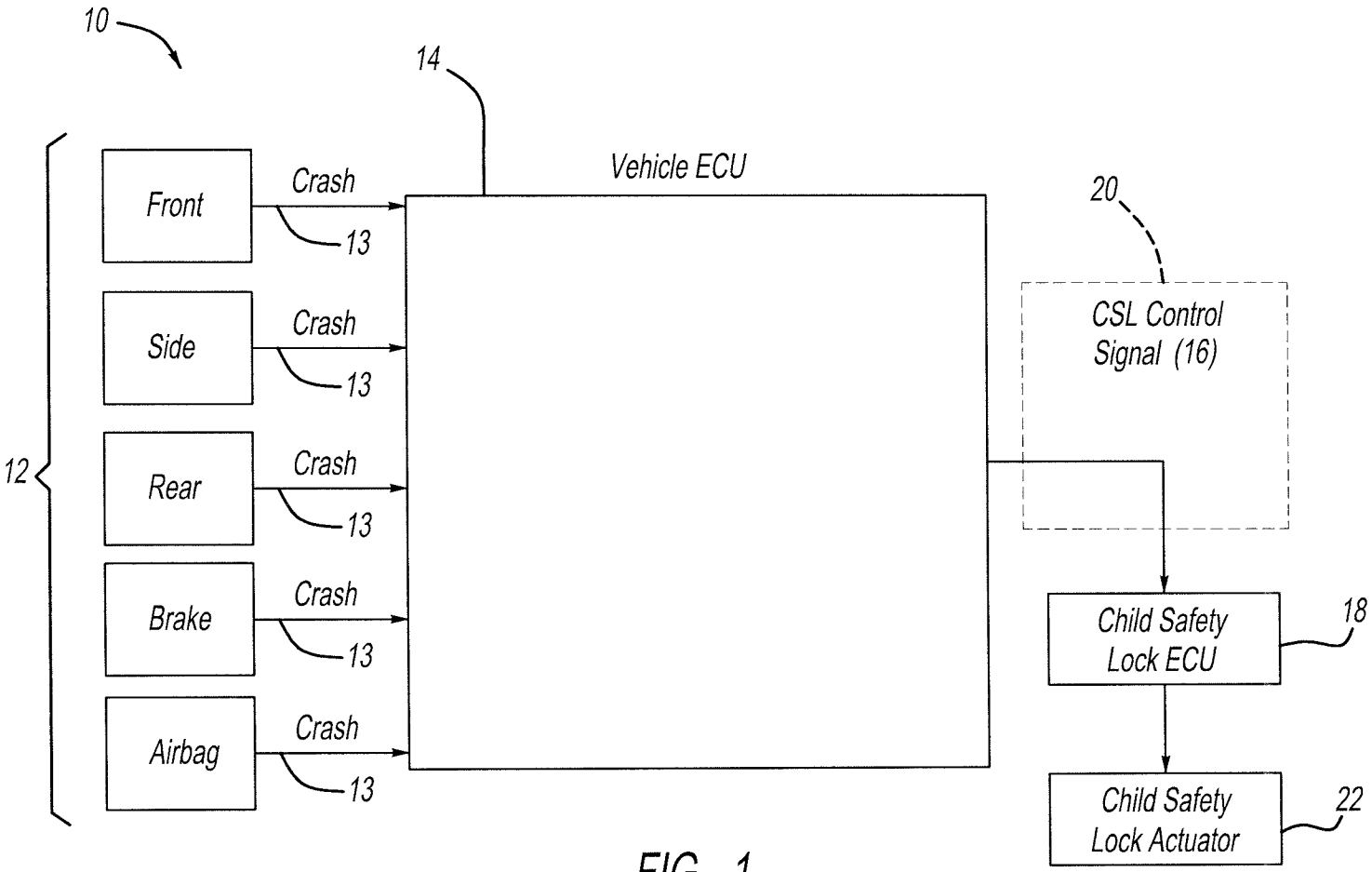
FIG. 1 is a general schematic diagram of an automated child safety unlocking system in accordance with one embodiment of the invention.

Referring now to the Figures, with particular reference to FIG. 1, a schematic diagram of an automated child safety unlocking system 10 is shown. The child safety unlocking system 10 uses two or more crash sensors 12 that are each configured to generate a crash signal upon detection of an event. The two or more crash sensors 12 are located at various portions on a vehicle body. The crash sensors 12 can include pressure sensors, accelerometers, light sensors, or virtually any other type of sensor capable of sensing or detecting an event such as a vehicle collision with an object or other vehicle. Depending upon the number of crash sensors 12 that generate a crash signal 13, the child safety unlocking system can be configured to determine the severity of a vehicle impact using the information or crash signal or the number or type of crash signal generated from the crash sensors 12. The crash sensors 12 are configured to generate the crash signal 13 only upon detection of an event, where if no event is detected, no signal will be sent. The crash sensors 12 are placed at different locations on the vehicle exterior and interior of the vehicle cabin. Examples of sensor locations and functions include front, side and rear sensors, brake sensors, airbag sensors and virtually any other type of sensor suitable for detecting an event, such as a vehicle crash.

Crash sensors 12 generate a crash signal to a vehicle ECU 14 that is configured to receive a crash signal from each of the sensors 12. The vehicle ECU 14 is then configured to transmit one of at least two child safety lock (CSL) command signals 16. The type of CSL command signal transmitted is specific to an event severity and event type, which can be determined by the number of crash signals 13 or the types of crash sensors 12 transmitting the crash signal 13. The CSL command signals 16 are generated by the vehicle ECU 14 to a child safety lock ECU 18.

The transmission of the CSL command signals 16 can be done by an independent communication bus directly coupled to the child safety lock ECU 18 or, in a preferred embodiment of the invention; the vehicle ECU 14 transmits the CSL command signals 16 as part of the general signals over a general vehicle communication bus 20. The general signals over the general vehicle communication bus 20 include other types of signals that go to other vehicle systems. This allows for a general or centralized arrangement of communication between the vehicle ECU 14 and the child safety lock ECU 18, without having to provide a designated wiring or communication link.

The child safety lock ECU 18 is configured to receive the general signals transmitted through the general vehicle communication bus 20. The child safety lock ECU 18 filters the one of at least two CSL command signals 16 from the general vehicle communication bus 20. The child safety lock ECU 18 then selectively disengages a child safety lock actuator 22 in response to the type of CSL command signal 16 received by the child safety lock ECU 18. Disengagement of the child safety lock actuator 22 can mean that the child safety features are disengaged so that the door can be unlocked by anyone inside of the vehicle. Additionally disengagement of the child safety lock actuator 22 also includes disabling the child safety lock features and unlocking the vehicle door so that someone from outside of the vehicle can open the unlocked door.

The engagement or disengagement of the child safety lock actuator 22 is controlled by the child safety lock ECU 18. The child safety lock ECU 18 is configurable to adjust the amount of time before the child safety lock ECU 18 disengages the child safety lock actuator 22 depending upon the type of CSL command signal 16 transmitted by the vehicle ECU 14. For example, if the child safety lock ECU 18 receives a CSL command signal 16 that indicates that the event severity was not very great or the type of event that occurred was not overly dangerous, then the child safety lock ECU 18 may forgo disengaging the child safety lock actuator 22. Or, if the event severity or event type is such that it indicates that the crash is occurring for a certain duration or period of time, such as a multiple vehicle collision or vehicle roll over scenario, then the child safety lock ECU 18 may delay the disengagement of the child safety lock actuator 22 for a predetermined period of time that is programmed into the child safety lock ECU 18, while in another example, if the event severity or event type was severe and the circumstances are known to indicate that the crash has ended, but there is imminent danger and person need to exit the vehicle, the child safety lock ECU 18 is preprogrammed to immediately disengage the child safety lock actuator 22 without any delay of time. This allows for the door to be immediately opened from the inside or outside. The amount of delay or action to be taken by the child safety lock ECU is all pre-programmable onto the child safety lock ECU and can be changed or adjusted depending upon the circumstances or known circumstances of a crash.

The communication between ECUx and ECUy (crash notification data) can be realized by one or a combination of the following types of communication:

Digital: e.g. CAN, Flex-ray, LIN, Kline, etc.

Analog: Based on exceeding an analog threshold in the signal (positive or negative slopes);

Analog PWM: Based on an analog PWM signal.

Frequency/period can be configured based on needs.

It will be readily appreciated that combinations of these may be used for redundancy if necessary.

Figure 2A:
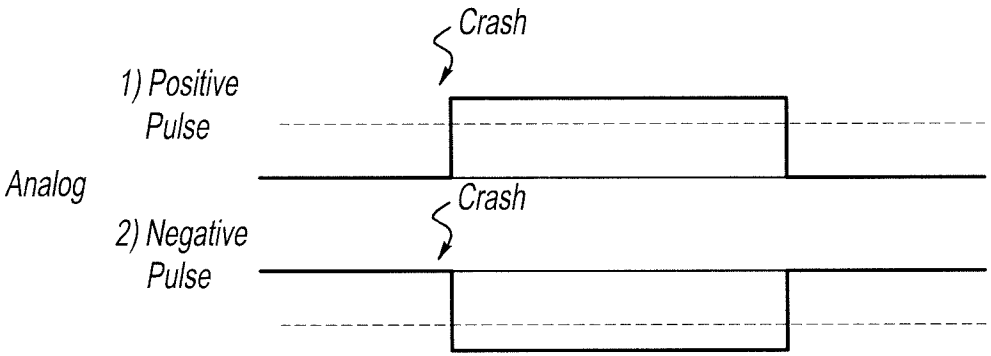
FIG. 2A is a graphical illustration of an analog control signal for use in the automated child safety unlocking system in accordance with another embodiment of the invention.
Figure 2B:
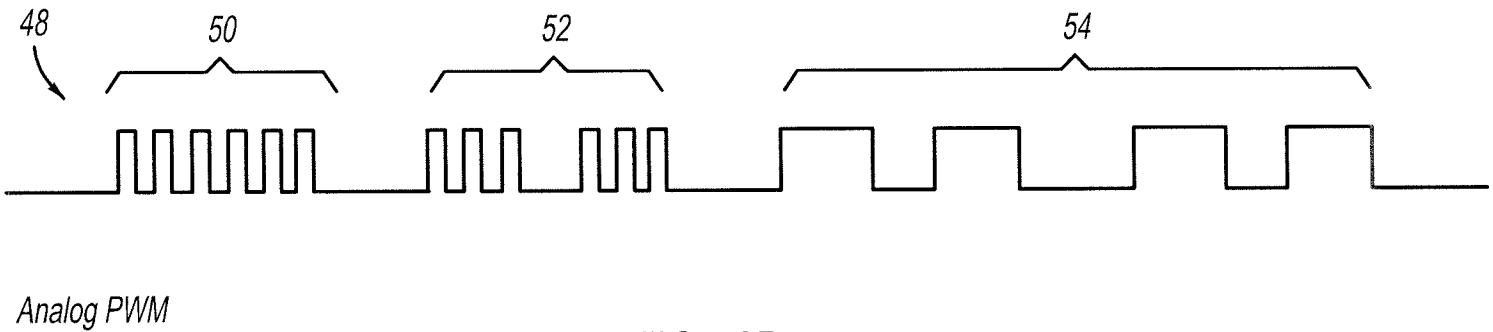
FIG. 2B is a graphical example of an analog pulse width modulated control signal for use in connection with the automated child safety unlocking system.

FIGS. 2A and 2B show examples of analog signals that are transmittable as the CSL command signal 16 between the vehicle ECU 14 and the child safety lock ECU 18. FIG. 2A shows two analog signals implementing a positive pulse or negative pulse in the signal when a crash occurs. As shown a constant value signal is transmitted between the vehicle ECU 14 and the child safety lock ECU 18. When an event is detected by the vehicle ECU 14 the analog signal, transmitted as the CSL command signal 16 can pulse positive, negative or both. Depending on if the signal pulses positive or negative will control whether the child safety lock ECU 18 engages or disengages the child safety lock actuator 22. For example the child safety lock ECU 18 can be programmed to delay disengagement of the child safety lock actuator 22 for any programmable period of time such as 5, 10, 15, 20 seconds if the pulse is negative, which is programmed to indicate a severe or longer duration crash or event. In the same example the child safety lock ECU 18 can be programmed to immediately disengage the child safety lock actuator 22 if the pulse if positive, indicating a less severe of short duration crash or event.

FIG. 2B shows an example of a pulse width modulated analog signal 48 that is transmittable as a CSL command signal 16 between the vehicle ECU 14 and the child safety lock ECU 18. The signal 48 contains a first set of pulses 50 of varying interval and intensity, a second set of pulses 52 of varying interval and intensity and a third set of pulses 54 of varying interval and intensity. The child safety lock ECU 18 is programmable to monitor the pulse width modulated signal 48 and determine what type of event has occurred based on the set of pulses received and how the child safety lock actuator 18 is programmed to respond. For example the set of pulses 50 could indicate no action should be taken and the child safety lock actuator 22 should not change state because either no event has occurred or the type of event that has occurred does not warrant disengagement of the child safety lock actuator 22. An example of such an event would be if a minor crash occurred and the driver might need to exit the vehicle, but would not want the child safety lock doors unlocked to keep children from exiting the vehicle where they would be exposed to passing traffic. The set of pulses 52 could indicate an event that is severe but short in duration and require the immediate disengagement of the child safety lock actuator 22. Example could be a vehicle crash where the car has stopped moving but is on fire. The set of pulses 54 could indicate that a severe event has occurred that will be long in duration, therefore, there will be a delay before disengagement of the child safety lock actuator 22. An example would be a crash where the vehicle rolls multiple times or a multi-vehicle crash. The way the child safety lock ECU 18 reacts to the different pulses is completely programmable to any desired action or duration before action takes place depending on a particular application or customer requirement.

Figure 4A:
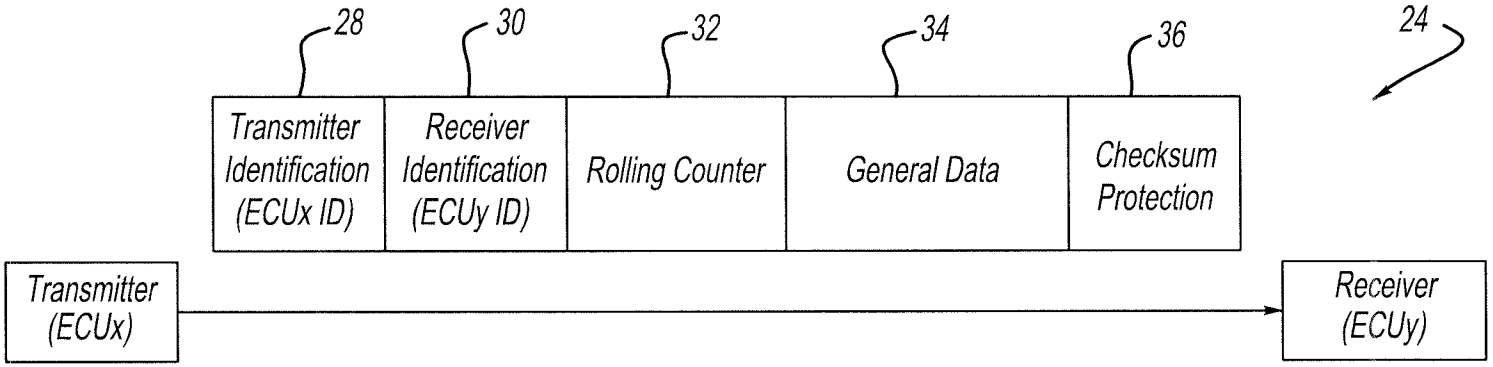
FIG. 4A is a schematic diagram of digital communications between the vehicle ECU and the child safety lock ECU.
Figure 4B:
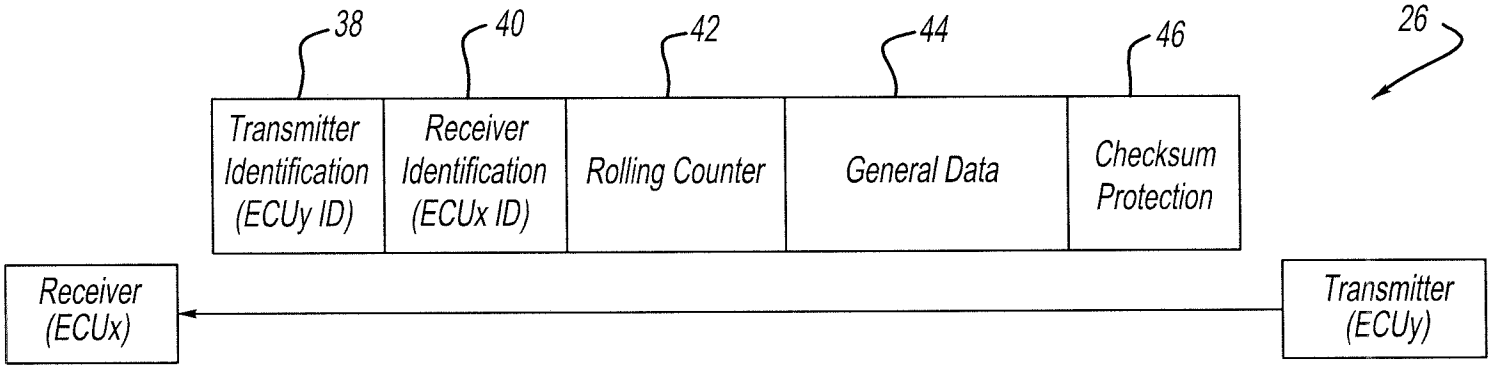
FIG. 4B is a schematic diagram of digital communications between the vehicle ECU and the child safety lock ECU.

FIG. 4 is a schematic diagram of digital CSL signals 16 transmitted between the vehicle ECU 14 and the child safety lock ECU 18. As shown the top portion of the diagram schematically shows a digital signal 24 transmitted from the vehicle ECU 14 to the child safety lock ECU 18, while the bottom portion of the diagram shows a digital signal 26 transmitted from the child safety lock ECU 18 to the vehicle ECU 14. The digital signal 24 includes a transmitter identification portion 28 and a receiver identification portion 30, which allows the child safety lock ECU 18 to identify that the digital signal 24 is coming from the vehicle ECU 14 and is intended for the child safety lock ECU 18. This enables the child safety lock ECU 18 to filter the digital signal 24 from the other signals of the general communication bus 20. The digital signal 24 also contains a rolling counter portion 32 that defines the size of the signal being transmitted. A general data portion 34 of the digital signal 24 contains information concerning the event status, severity and type. The general data portion is used by the child safety lock ECU 18 to determine when and whether to disengage the child safety lock actuator 22. Additionally the general data portion 24 contains other data or information requests concerning but not limited to child safety lock actuator 22 status request, customer diagnostic request, child safety lock ECU 18 and child safety lock actuator 22 verification of test request. The digital signal 24 also contains a checksum protection portion 36 that allows the child safety lock ECU 18 to confirm that the entire message of the digital signal 24 was received.

When the general data portion 34 contains a request for information from the child safety lock ECU 18 or when the child safety lock ECU 18 is programmed to automatically send a signal to the vehicle ECU 14, the digital signal 26 is transmitted. The digital signal 26 includes a transmitter identification portion 38 and a receiver identification portion 40, which allows the vehicle ECU 14 to identify that the digital signal 26 is coming from the vehicle ECU 14 and is intended for the child safety lock ECU 18, this enables the vehicle ECU 14 to filter the digital signal 26 from the other signals of the general communication bus 20. The digital signal 26 also contains a rolling counter portion 42 that defines the size of the signal being transmitted. A general data portion 44 of the digital signal 26 contains information concerning the event status, severity and type. Additionally the general data portion 44 contains other data or information requests concerning but not limited to child safety lock actuator 22 status, customer diagnostic information, child safety lock ECU 18 and child safety lock actuator 22 verification of test response. The digital signal 26 also contains a checksum protection portion 46 that allows the child safety lock ECU 18 to confirm that the entire message of the digital signal 26 was received.

Figure 3:
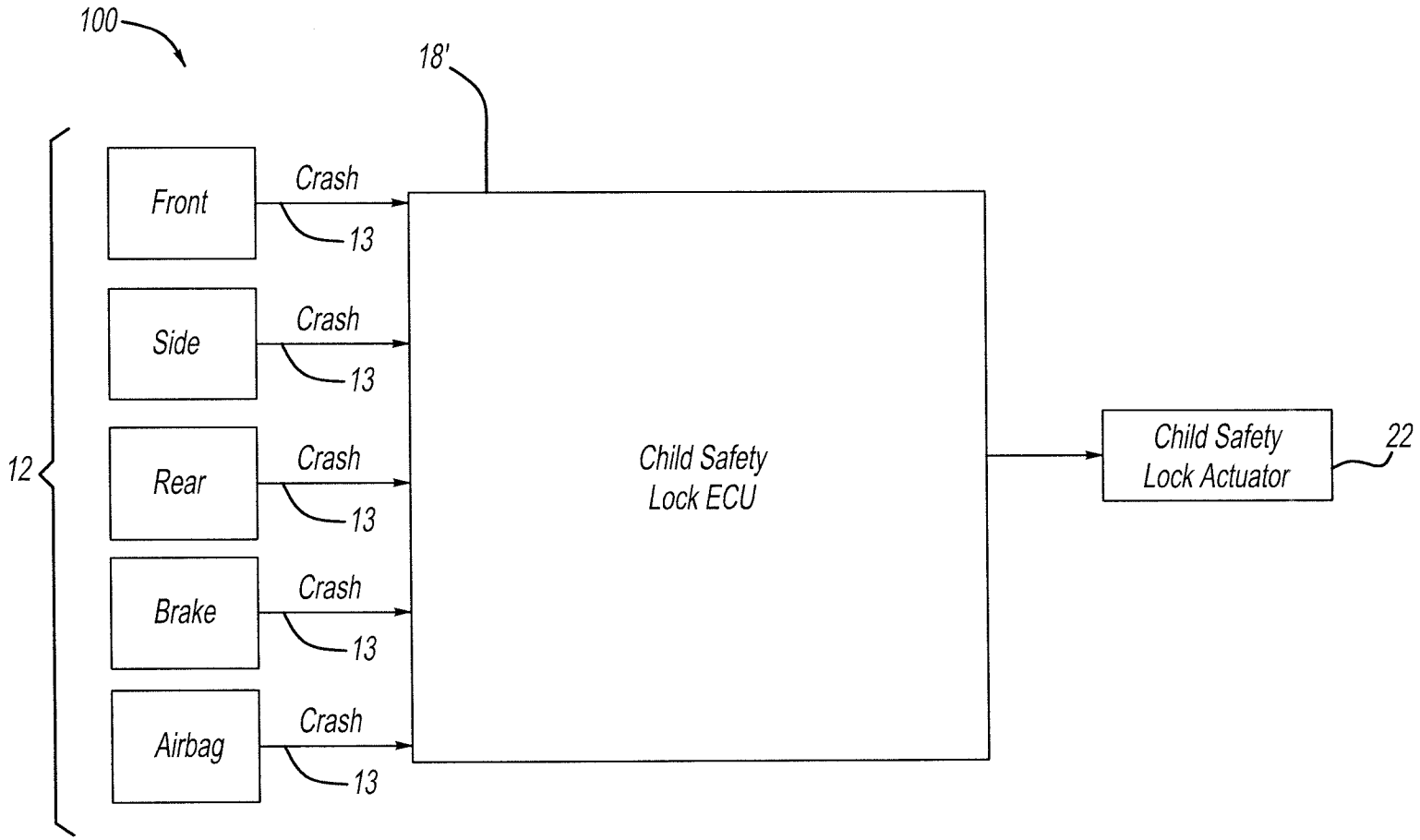
FIG. 3 is a schematic diagram of the automated child safety unlocking system in accordance with a second embodiment of the present invention.

FIG. 3 depicts a second embodiment of the invention showing an automated child safety lock unlocking system 100 using the same reference numbers for identical components show in FIG. 1, with variations labelled with prime numbers. The automated child safety lock unlocking system 100 has the same crash sensors 12 as shown in FIG. 1, with crash signals 13 being transmitted directly to a child safety lock ECU 18'. The child safety lock ECU 18' determines the type of crash and the appropriate time for disengaging the child safety lock actuator 22. The present embodiment eliminates the need for having the vehicle ECU 14 and sending signals through the general communications bus 20 as described in FIG. 1 above.

Figure 5:
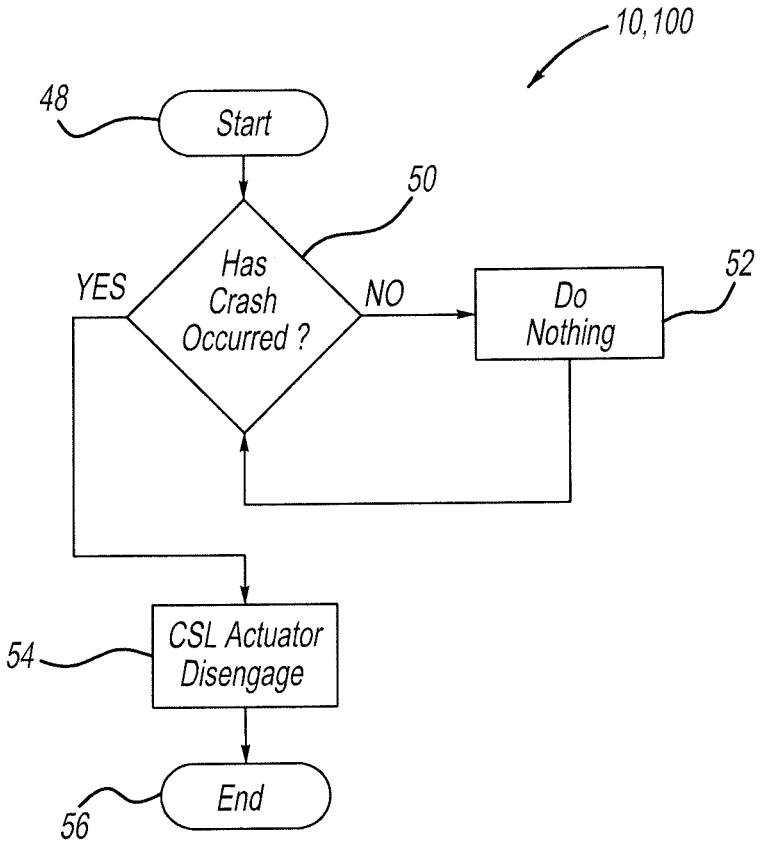
FIG. 5 is a decision box diagram of the automated child safety unlocking system in accordance with the present invention.

Referring now to FIG. 5 a decision box diagram of the automated child safety unlocking system 10, 100 in accordance with the present invention where the steps outlining the monitoring the operation of the automated child safety unlocking system 10, 100 is functioning. At a start step 48 the vehicle ignition is turned on and the child safety lock system has gone through a check sequence as described below in FIG. 6. At decision step 50 "Has Crash Occurred/" the system 10, 100 determines if a crash has occurred. The term "crash" as used herein means any event that warrants a change in the child safety lock status. This determination is made by the vehicle ECU or the child safety lock ECU depending on the arrangement and programming of the controllers. If at the decision step 50 it is determined that no crash has occurred then the child safety lock ECU will move to a "Do Nothing" step 52 and take no action to disengage the child safety lock actuator. The system 10,100 will continue to cycle back to the decision step 50 at programmed intervals or up receipt of more information by the vehicle ECU or child safety lock ECU until at the decision step 50 it is determined that a crash has occurred. At the decision step 50 a determination is also made as to the type of crash and event and whether or not there should be a delay in taking action. If the system 10, 100 determines that a crash has occurred then at step 54 the child safety lock actuator is commanded to disengage. After step 54 the system 10, 100 will take no further action until the vehicle has turned off and then will restart the process at step 48 upon starting of the vehicle.

Figure 6:
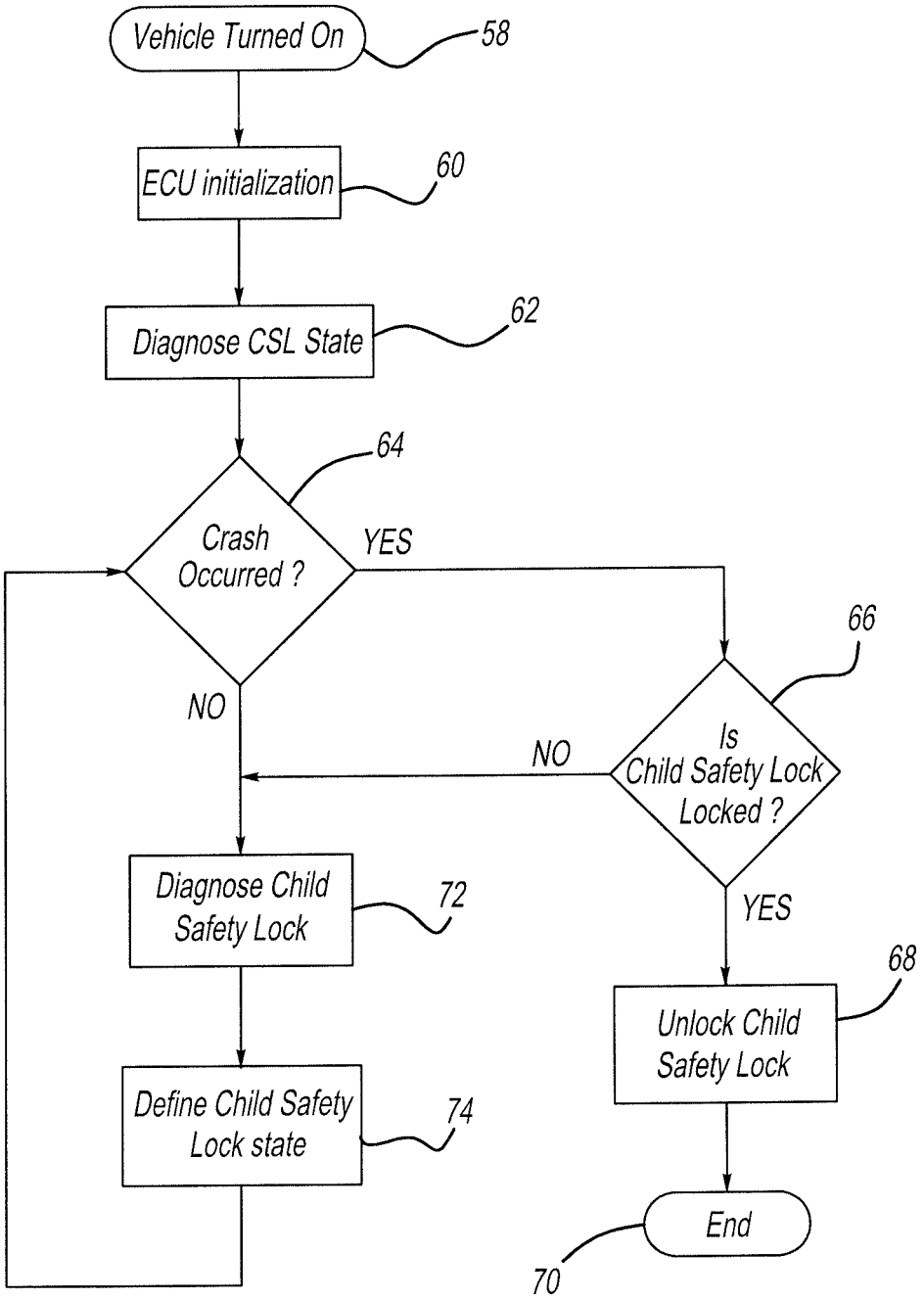
FIG. 6 is a decision box diagram showing an operational overview of the automated child safety unlocking system in accordance with the present invention.

FIG. 6 is a decision box diagram showing more details concerning the operational routine of the invention. Upon a vehicle turn on step 58, vehicle ECU (if present) and the child safety lock ECU at step 60 "ECU init" operates in an initialization mode. At step 62 "Diagnose CSL State" the child safety lock ECU determines that state of the child safety lock actuator, which can be engaged or disengaged. At a decision step 64 the child safety lock ECU waits until a determination is made whether a "crash occurred?" This includes a determination of whether a crash has occurred that warrants unlocking the child safety lock. If at decision step 64 the answer is "YES" then at decision step 66 a determination is made whether "child safety lock locked?" This determination is made by information obtained at step 62 where the child safety lock state is determined, however, the child safety lock ECU may also perform a subsequent diagnosis of the state of the child safety lock. If is determined that the child safety lock is locked then at step 68 the child safety lock will be unlocked and at step 70 operational routine until the vehicle is turned off and then back on.

If at decision step 64 it is determined that no crash occurred than at steps 72 the child safety lock ECU will "diagnose the child safety lock" and step 74 will "define child safety lock state" in order to perform a self test or diagnose the child safety lock. This will allow the child safety lock ECU to check or confirm the status of the child safety lock to store in the memory of the child safety lock ECU where the routine will cycle back to decision step 64. Steps 72, 74 will also allow the child safety lock ECU to check for failure of the child safety lock.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An automated child safety unlocking system comprising:

two or more crash sensors each configured to generate a crash signal upon detection of an event;

a vehicle ECU configured to receive the crash signal from each of the two or more crash sensors, said vehicle ECU being configured to transmit one of at least two CSL command signals, said at least two CSL command signals are each specific to an event severity and event type, wherein the one of at least two CSL command signals generated by the vehicle ECU is transmitted with general signals over a general vehicle communication bus; and a child safety lock ECU configured to receive the general signals transmitted through the general vehicle communication bus, wherein the child safety lock ECU filters the one of at least two CSL command signals from the general vehicle communication bus, said child safety lock ECU engages or disengages a child safety lock actuator depending on the one of at least two CSL command signals received by the child safety lock ECU.

2. The automated child safety unlocking system of claim 1 wherein the child safety lock ECU is configurable to adjust the amount of time before the child safety lock ECU disengages the child safety lock actuator depending on the type of CSL command signal transmitted by the vehicle ECU.

3. The automated child safety unlocking system of claim 2 wherein the type of CSL command signal is a pulse width modulated analog signal that has a default state that changes to one of at least two different states based on the event severity and the event type.

4. The automated child safety unlocking system of claim 2 wherein the type of CSL command signal is a digital signal.

5. The automated child safety unlocking system of claim 2 wherein the type of CSL command signal is a digital signal that instructs the child safety lock ECU to disengage or engage the child safety lock actuator depending on the type of CSL command signal transmitted by the vehicle ECU.

6. The automated child safety unlocking system of claim 1 wherein the child safety lock ECU engages and disengages the child safety lock actuator depending on the one or more of the following factors including: configurable delay time programmed into the child safety lock ECU that starts counting delay time after reception of crash notification digital data as part of one of the at least two CSL command signals, configurable time based on the number of crash notifications received from the one of at least two CSL command signals, configurable time based on the one of at least two CSL command signals being an analog crash notification pulse and configurable based on the child safety lock ECU receiving a number of analog crash notification pulses as part of the one or at least two CSL command signals.

7. The automated child safety unlocking system of claim 1 wherein the child safety lock ECU is capable of transmitting though the general vehicle communication bus one or more CSL information signals wherein the vehicle ECU received the general signals transmitted through the general vehicle communication bus and filters the one or more CSL information signals.

8. The automated child safety unlocking system of claim 7 wherein the one or more CSL information signals contains information relating to the child safety lock actuator status, child safety lock diagnostics, data response, function execution response, customer diagnostic response data.

9. An automated child safety unlocking system comprising:

two or more crash sensors each configured to generate a crash signal upon detection of an event;

a vehicle ECU configured to receive the crash signal from each of the two or more crash sensors, said vehicle ECU being configured to transmit one of at least two CSL command signals, said at least two CSL command signals are each specific to an event severity and event type, wherein the one of at least two CSL command signals generated by the vehicle ECU is transmitted with general signals over a general vehicle communication bus; and a child safety lock ECU configured to receive the general signals transmitted through the general vehicle communication bus and the child safety lock ECU filters the one of at least two CSL command signals from the general vehicle communication bus, said child safety lock ECU engages or disengages a child safety lock actuator depending on the one of at least two CSL command signals received by the child safety lock ECU, wherein the child safety lock ECU is capable of transmitting though the general vehicle communication bus one or more CSL information signals wherein the vehicle ECU received the general signals transmitted through the general vehicle communication bus and filters the one or more CSL information signals, the one or more CSL information signals contains information relating to the child safety lock actuator status, child safety lock diagnostics, data response, function execution response, customer diagnostic response data.

10. The automated child safety unlocking system of claim 9 wherein the child safety lock ECU is configurable to adjust the amount of time before the child safety lock ECU disengages the child safety lock actuator depending on the type of CSL command signal transmitted by the vehicle ECU.

11. The automated child safety unlocking system of claim 10 wherein the type of CSL command signal is a pulse width modulated analog signal that has a default state that changes to one of at least two different states based on the event severity and the event type.

12. The automated child safety unlocking system of claim 10 wherein the type of CSL command signal is a digital signal.

13. The automated child safety unlocking system of claim 10 wherein the type of CSL command signal is a digital signal that instructs the child safety lock ECU to disengage or engage the child safety lock actuator depending on the type of CSL command signal transmitted by the vehicle ECU.

14. The automated child safety unlocking system of claim 9 wherein the child safety lock ECU engages and disengages the child safety lock actuator depending on the one or more of the following factors including: configurable delay time programmed into the child safety lock ECU that starts counting delay time after reception of crash notification digital data as part of one of the at least two CSL command signals, configurable time based on the number of crash notifications received from the one of at least two CSL command signals, configurable time based on the one of at least two CSL command signals being an analog crash notification pulse and configurable based on the child safety lock ECU receiving a number of analog crash notification pulses as part of the one or at least two CSL command signals.

15. An automated child safety unlocking system comprising:

two or more crash sensors each configured to generate a crash signal upon detection of an event;

a vehicle ECU configured to receive the crash signal from each of the two or more crash sensors, said vehicle ECU being configured to transmit one of at least two CSL command signals, said at least two CSL command signals are each specific to an event severity and event type, wherein the one of at least two CSL command signals generated by the vehicle ECU is transmitted with general signals over a general vehicle communication bus; and a child safety lock ECU configured to receive the general signals transmitted through the general vehicle communication bus, wherein the child safety lock ECU filters the one of at least two CSL command signals from the general vehicle communication bus, said child safety lock ECU engages or disengages a child safety lock actuator depending on the one of at least two CSL command signals received by the child safety lock ECU, wherein the child safety lock ECU is configurable to adjust the amount of time before the child safety lock ECU disengages the child safety lock actuator depending on the type of CSL command signal transmitted by the vehicle ECU.

16. The automated child safety unlocking system of claim 15 wherein the type of CSL command signal is a pulse width modulated analog signal that has a default state that changes to one of at least two different states based on the event severity and the event type.

17. The automated child safety unlocking system of claim 15 wherein the type of CSL command signal is a digital signal.

18. The automated child safety unlocking system of claim 15 wherein the type of CSL command signal is a digital signal that instructs the child safety lock ECU to disengage or engage the child safety lock actuator depending on the type of CSL command signal transmitted by the vehicle ECU.

19. The automated child safety unlocking system of claim 15 wherein the child safety lock ECU engages and disengages the child safety lock actuator depending on the one or more of the following factors including: configurable delay time programmed into the child safety lock ECU that starts counting delay time after reception of crash notification digital data as part of one of the at least two CSL command signals, configurable time based on the number of crash notifications received from the one of at least two CSL command signals, configurable time based on the one of at least two CSL command signals being an analog crash notification pulse and configurable based on the child safety lock ECU receiving a number of analog crash notification pulses as part of the one or at least two CSL command signals.

20. The automated child safety unlocking system of claim 15 wherein the child safety lock ECU is capable of transmitting though the general vehicle communication bus one or more CSL information signals wherein the vehicle ECU received the general signals transmitted through the general vehicle communication bus and filters the one or more CSL information signals.

21. The automated child safety unlocking system of claim 20 wherein the one or more CSL information signals contains information relating to the child safety lock actuator status, child safety lock diagnostics, data response, function execution response, customer diagnostic response data.

* * * * *